US010737860B2

(12) United States Patent
Rorick et al.

(10) Patent No.: US 10,737,860 B2
(45) Date of Patent: Aug. 11, 2020

(54) SYSTEM OF PACKAGED ORAL CARE IMPLEMENTS

(71) Applicant: COLGATE-PALMOLIVE COMPANY, New York, NY (US)

(72) Inventors: Kevin Rorick, Cold Spring, NY (US); Jairo Garcia, New York, NY (US)

(73) Assignee: Colgate-Palmolive Company, New York, NY (US)

( * ) Notice: Subject to any disclaimer, the term of this patent is extended or adjusted under 35 U.S.C. 154(b) by 697 days.

(21) Appl. No.: 15/317,193

(22) PCT Filed: Jun. 12, 2014

(86) PCT No.: PCT/US2014/042137
§ 371 (c)(1),
(2) Date: Dec. 8, 2016

(87) PCT Pub. No.: WO2015/191070
PCT Pub. Date: Dec. 17, 2015

(65) Prior Publication Data
US 2017/0137191 A1 May 18, 2017

(51) Int. Cl.
*B65D 75/36* (2006.01)
*B65D 75/56* (2006.01)
(Continued)

(52) U.S. Cl.
CPC ..... *B65D 75/366* (2013.01); *A46B 9/04* (2013.01); *A46B 15/0081* (2013.01);
(Continued)

(58) Field of Classification Search
CPC .... B65D 75/366; B65D 75/54; B65D 75/563; B65D 77/003; B65D 5/4204;
(Continued)

(56) References Cited

U.S. PATENT DOCUMENTS 3,888,349 A 6/1975 MacFarland, Jr.
4,828,113 A * 5/1989 Friedland ..... A61C 3/005 206/369
(Continued)

FOREIGN PATENT DOCUMENTS

CA 2028957 A 5/1992
CA 2040222 9/1992
(Continued)

OTHER PUBLICATIONS

Piksters, 2007, "How and Why to Use Interdental Brushes" https://web.archive.org/web/20070704210323/http://www.piksters.com:80/_mgxroot/page_10743.html published on Jul. 4, 2007 as per Wayback Machine.
(Continued)

*Primary Examiner* — Chun Hoi Cheung
*Assistant Examiner* — Brijesh V. Patel

(57) ABSTRACT

A color coded oral care implement packaging system. In one embodiment, the system includes a first packaged oral care implement that includes a package and an oral care implement having a tooth cleaning element field with a first characteristic positioned within the package. The system also includes a second packaged oral care implement that includes a package and an oral care implement having a tooth cleaning field with a second characteristic positioned within the package. The first package includes a first designated area being color coded with a first color selected to represent the first characteristic. The second package includes a second designated area being color coded with a second color selected to represent the second characteristic.

11 Claims, 13 Drawing Sheets

(51) Int. Cl.
*A46B 9/04* (2006.01)
*A46B 15/00* (2006.01)
*A46D 1/00* (2006.01)

(52) U.S. Cl.
CPC ..... *A46D 1/0253* (2013.01); *A46D 1/0276* (2013.01); *B65D 75/563* (2013.01); *B65D 2203/00* (2013.01)

(58) Field of Classification Search
CPC .... B65D 5/4212; B65D 73/00; B65D 73/003; B65D 2203/00; A46B 15/0081; A46B 15/0091; A46B 15/0071; A46B 9/04; A46B 2200/1066; A46D 1/0276; A46D 1/0253; A61C 19/02; A61C 15/00
USPC ..... 206/63.5, 459.1, 369, 459.5, 581, 361, 206/362.2; 132/311, 309, 321
See application file for complete search history.

(56) References Cited

U.S. PATENT DOCUMENTS 4,978,521 A 12/1990 Blue
5,020,671 A 6/1991 Smith et al.
5,142,384 A * 8/1992 Wood ..... B65D 5/4204 206/457
5,423,427 A * 6/1995 Brown ..... A46B 5/0095 132/311
5,485,919 A 1/1996 Samberg et al.
6,397,860 B1 * 6/2002 Hill, II ..... A45D 44/18 132/309
6,461,164 B1 * 10/2002 Ramelli ..... A46B 5/00 15/167.1
6,715,603 B1 * 4/2004 Uribe ..... A61C 15/00 206/232
7,458,464 B1 * 12/2008 Kutsch ..... A46B 9/04 206/570
7,882,949 B1 2/2011 Singh
7,931,144 B2 4/2011 Lordo
7,992,710 B2 8/2011 Jimenez et al.
8,181,786 B1 * 5/2012 Alas ..... A46B 11/0065 132/311
2003/0075561 A1 * 4/2003 Pieri ..... B65D 75/527 222/94
2003/0234199 A1 * 12/2003 Morita ..... A61F 15/001 206/459.5
2004/0010240 A1 * 1/2004 Ronn ..... A61F 13/84 604/358
2004/0216341 A1 * 11/2004 Moran ..... G09F 3/00 40/311
2004/0237226 A1 12/2004 Hohlbein et al.
2006/0042992 A1 * 3/2006 Vulcano ..... A45C 5/03 206/581
2007/0199848 A1 * 8/2007 Ellswood ..... A61B 42/40 206/459.5
2007/0209263 A1 * 9/2007 Hohlbein ..... A46B 5/02 40/625
2007/0295629 A1 12/2007 Adriaanse et al.
2008/0110782 A1 * 5/2008 Burgdorf ..... A61F 13/551 206/438
2009/0006198 A1 1/2009 Walsh et al.
2009/0008271 A1 * 1/2009 Zimmer ..... A47F 3/00 206/63.5
2009/0188826 A1 7/2009 Porteous et al.
2009/0215003 A1 * 8/2009 Swain ..... A61C 7/00 433/24
2009/0236241 A1 * 9/2009 Jimenez ..... A61C 17/221 206/63.5
2010/0072099 A1 * 3/2010 Klein ..... B65D 51/20 206/459.5
2010/0200435 A1 * 8/2010 Baus ..... B65D 75/32 206/361
2010/0203471 A1 8/2010 Bae
2013/0252206 A1 9/2013 Lee
2013/0276815 A1 10/2013 Hohlbein et al.
2013/0298911 A1 * 11/2013 Wlaschin ..... A61M 16/04 128/207.14
2014/0008266 A1 1/2014 Lee et al.
2014/0083885 A1 * 3/2014 Lee ..... B65D 75/32 206/361
2015/0282603 A1 * 10/2015 Jimenez ..... A46B 11/0065 132/311
2016/0137373 A1 * 5/2016 Olschan ..... B65D 73/0064 206/372

FOREIGN PATENT DOCUMENTS

CN 101410305 A 4/2009
EP 1558108 8/2005

OTHER PUBLICATIONS

Wison, 2013, "Beauty and the Bold‡Product Review: Colgate Optic White," http://www.beautyandthebold.com/2013/04/productreviewcolgateopticwhite.html.
International Search Report and the Written Opinion of the International Searching Authority issued in International Application PCT/US2014/042137 dated Mar. 13, 2015.
HTTP Comunicacio: "DENTAID—Experts in oral health, halita, vitis, desensin, interprox . . . ", Oct. 6, 2009 (Oct. 6, 2009), XP055172971, Retrieved from the Internet <URL:http://web.archive.org/web/20091006042533/http://www.dentaid.es/web_id/fra/nuestrasmarcas.php?f=48> [retrieved on Mar. 2, 2015].

* cited by examiner

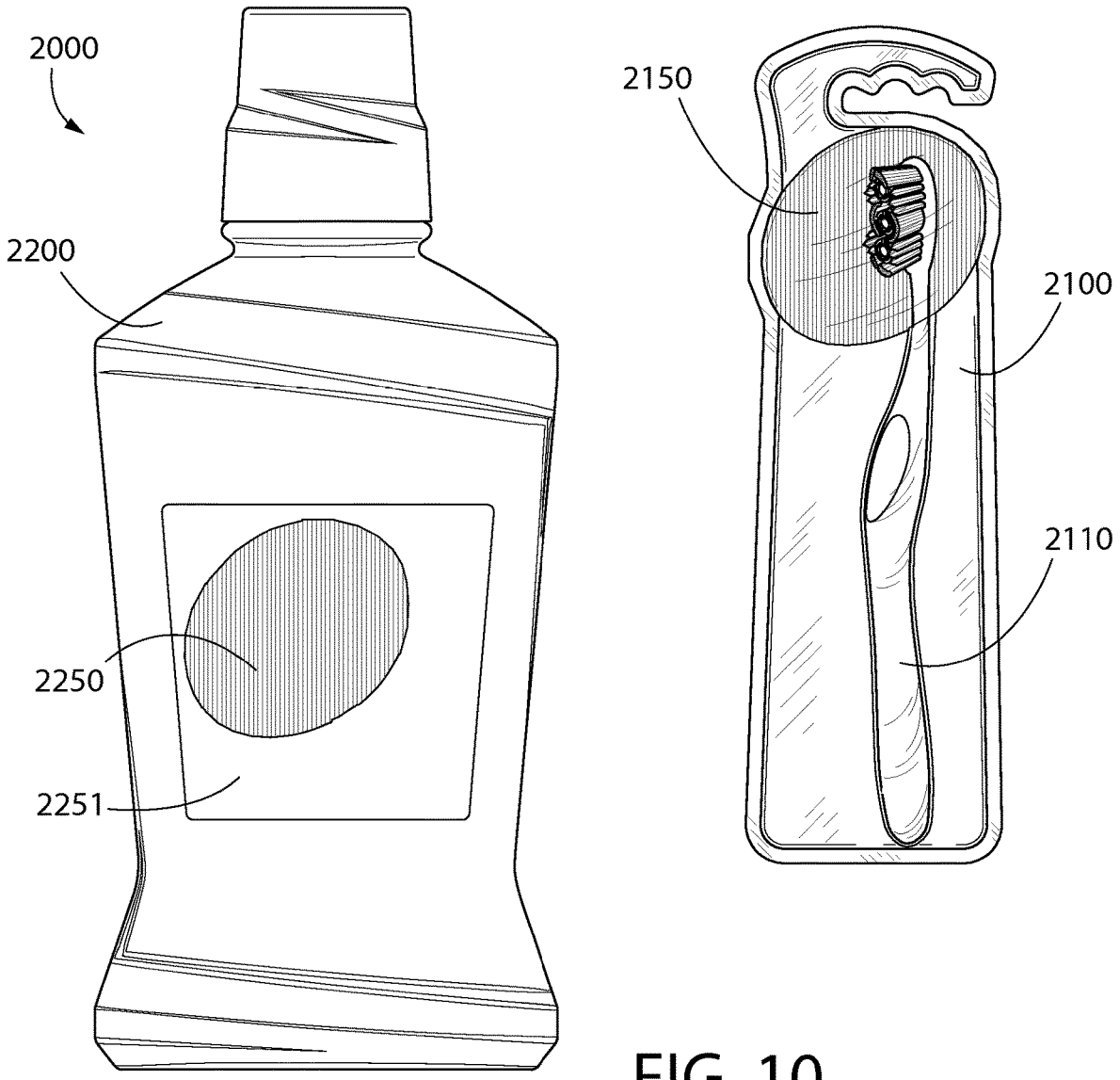
FIG. 10
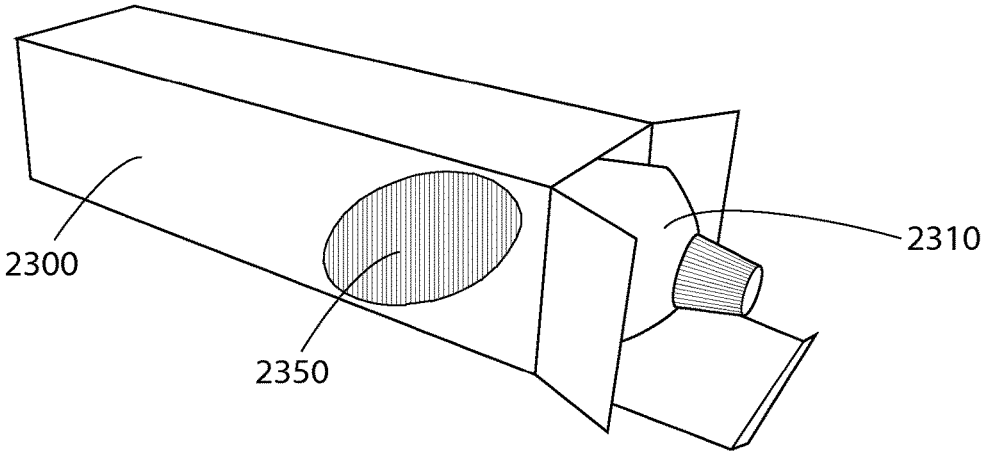

SYSTEM OF PACKAGED ORAL CARE IMPLEMENTS

BACKGROUND

In the commercialization of toothbrushes and other oral care implements, the current trend is to package toothbrushes in blister packages. Often one company will offer many different lines of toothbrushes for sale, each line of toothbrushes having multiple different toothbrushes that offer different benefits to a user during toothbrushing. Specifically, one toothbrush in a line may be best used for tooth whitening while another toothbrush in a line may be best used for interdental cleaning. Using conventional packaging techniques, a consumer must approach the packaged toothbrushes very closely in order to read the small writing provided on the package that describes the particular benefits of each toothbrush. This can result in a time consuming process, particularly for individuals who have poor eye sight. Thus, a need exists for a toothbrush and other oral care implement packaging system that makes it easy for a consumer to quickly determine the specific and particular benefits of each toothbrush in a line of toothbrushes to assist a consumer in purchasing the toothbrush that best fits his or her needs.

BRIEF SUMMARY

The present invention may be directed, in one aspect, to a color coded oral care implement packaging system. The system comprises a first packaged oral care implement that includes a package and an oral care implement having a tooth cleaning element field with a first characteristic positioned within the package. The system also comprises a second packaged oral care implement that includes a package and an oral care implement having a tooth cleaning field with a second characteristic positioned within the package. The first package includes a first designated area being color coded with a first color selected to represent the first characteristic. The second package includes a second designated area being color coded with a second color selected to represent the second characteristic.

In one embodiment, the invention can be a color coded oral care implement packaging system comprising: a first packaged oral care implement comprising: a first package comprising a first product retaining cavity; a first oral care implement positioned within the first product retaining cavity, the first oral care implement comprising a first tooth cleaning element field having a first characteristic; and a first designated area located on a visible surface of the first package, the first designated area being color coded with a first color selected to represent the first characteristic; and a second packaged oral care implement comprising: a second package comprising a second product retaining cavity; a second oral care implement positioned within the second product retaining cavity, the second oral care implement comprising a second tooth cleaning element field having a second characteristic, the second characteristic being different than the first characteristic; and a second designated area located on a visible surface of the second package, the second designated area being color coded with a second color selected to represent the second characteristic.

In another embodiment, the invention can be a color coded toothbrush packaging system comprising: a plurality of packages containing a plurality of toothbrushes, each of the plurality of toothbrushes configured to achieve one of a plurality of different oral care benefits; a color coding system comprising a plurality of colors, each of the plurality of colors selected to be indicative of a specific one of the plurality of different oral care benefits; and each of the plurality of packages comprising, on a visible area, a designated area having a color of the plurality of colors that is indicative of the oral care benefit which the toothbrush in that package is configured to achieve.

In a further embodiment, the invention can be a color coded oral care implement packaging system comprising: a plurality of packages containing at least one of a plurality of oral care implements, each of the plurality of oral care implements having a portion having one of a plurality of different characteristics; a color coding system comprising a plurality of colors, each of the plurality of colors selected to be indicative of a specific one of the plurality of different characteristics; each of the plurality of packages comprising, on a visible area, a designated area having a color of the plurality of colors that is indicative of the characteristic which the oral care implement in that package has; and the plurality of oral care implements positioned within the plurality of packages so that the portions of the plurality of oral care implements overlie the designated areas.

In a yet further embodiment, the invention can be a color coded oral care product packaging system comprising: a plurality of packages containing at least one of a plurality of oral care products, each of the plurality of oral care products configured to achieve one of a plurality of different oral care benefits; a color coding system comprising a plurality of colors, each of the plurality of colors selected to be indicative of a specific one of the plurality of oral care benefits; and each of the plurality of packages comprising, on a visible area, a designated area having a color of the plurality of colors that is indicative of the oral care benefit which the oral care product in that package is configured to achieve.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 10 illustrates a color coded oral care product packaging system including a plurality of packages containing different oral care products.

DETAILED DESCRIPTION

Figure 1:
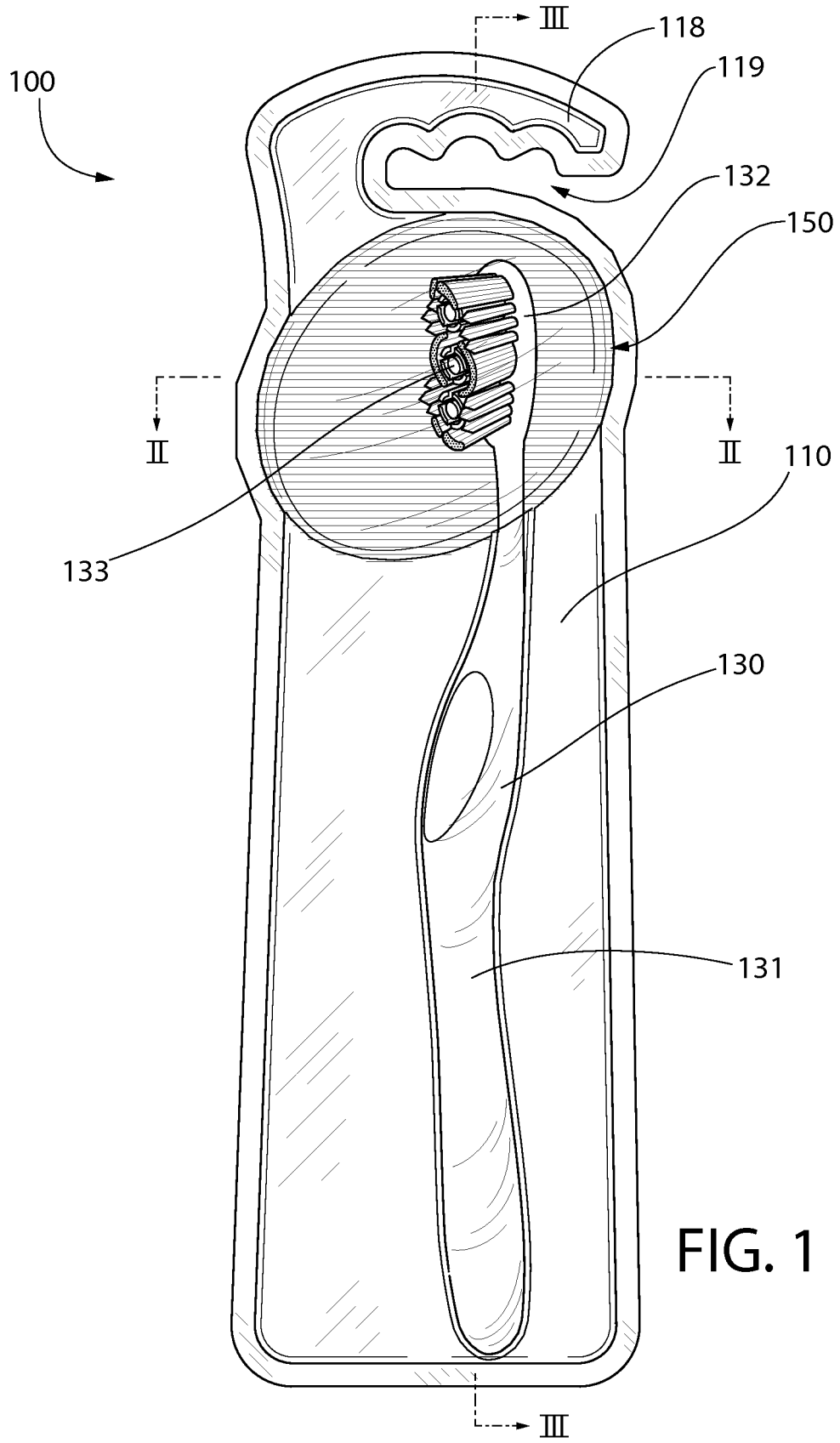
FIG. 1 is a front view of a packaged oral care implement including a package and an oral care implement in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 2:
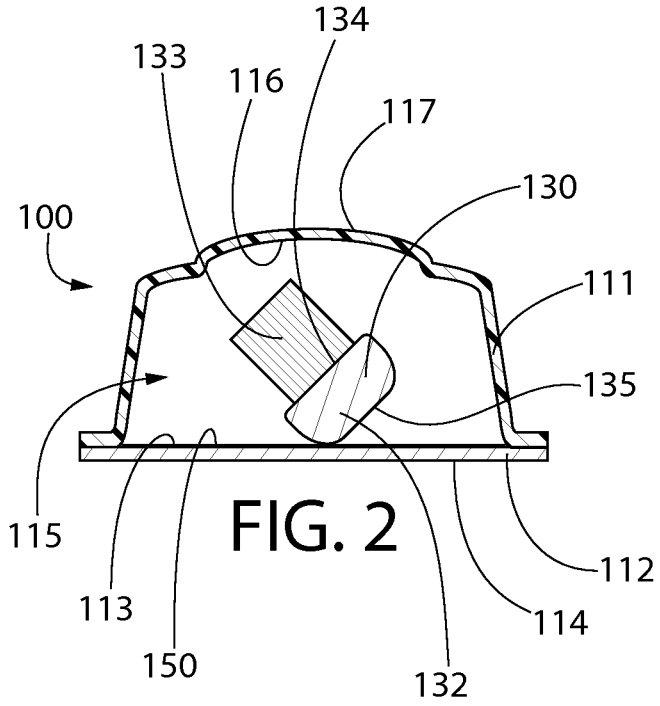
FIG. 2 is a cross-sectional view taken along line II-II in FIG. 1.
Figure 3:
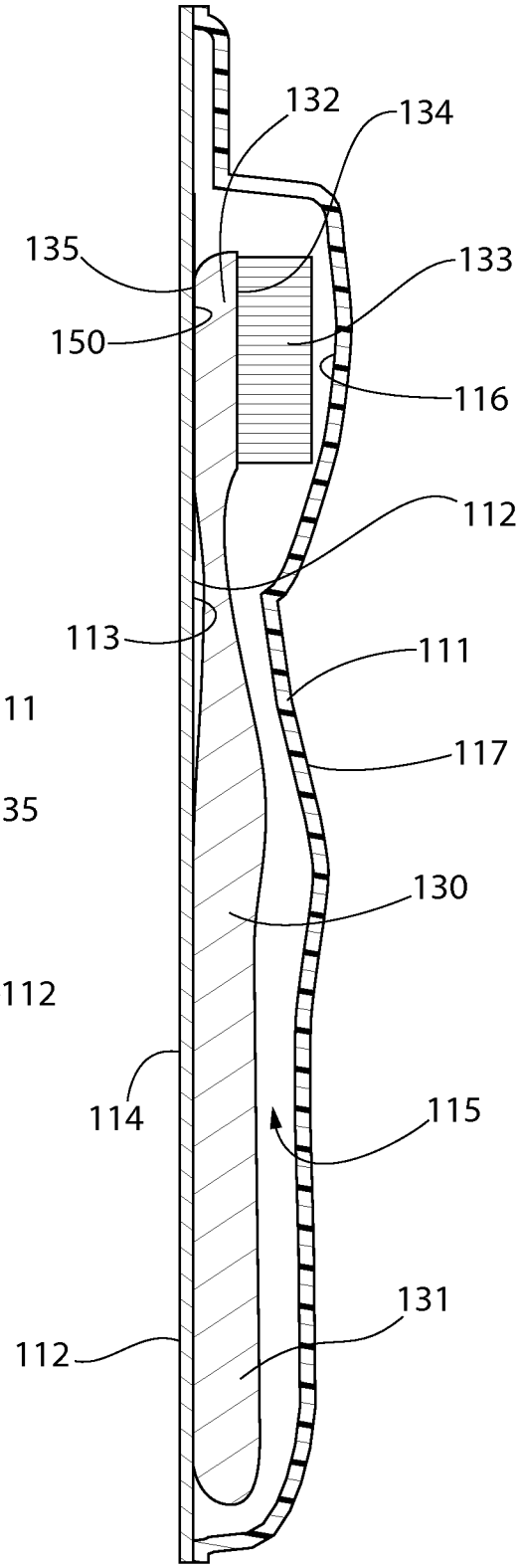
FIG. 3 is a cross-sectional view taken along line III-III in FIG. 1.

Referring to FIGS. 1-3 concurrently, a first packaged oral care implement 100 comprising a first package 110 and a first oral care implement 130 will be described. As will be appreciated from the description below, particularly with regard to FIGS. 4-8B, in certain embodiments the invention is directed to an oral care implement packaging system that includes first, second and possibly even third and fourth (and more if desired) packaged oral care implements. However, the structure of each such packaged oral care implement, and more specifically the structure of each package, is identical. Thus, the description of FIGS. 1-3 herein with regard to the structure of the first packaged oral care implement 100 (and the general structure of the first package 110, the first oral care implement 130 and the cooperative relationship between the two) is applicable to each of the first, second, third and fourth packaged oral care implements. The structural features of the first package 110 and the first oral care implement 130 will only be described once with regard to FIGS. 1-3, it being understood that the same discussion and description is applicable to each packaged oral care implement in the oral care implement packaging system discussed below with regard to FIGS. 4-8B. Thus, the use of the terms "first," "second," "third," and "fourth" herein is merely intended to distinguish among the different packaged oral care implements and their components and features.

As noted above, the first packaged oral care implement 100 comprises the first package 110 and the first oral care implement 130, the first oral care implement 130 being housed or packaged within the first package 110. In the exemplified embodiment, the first package 110 generally comprises a first transparent panel 111 and a first backer panel 112. The first transparent panel 111 has an inner surface 116 and an outer surface 117. Furthermore, the first transparent panel 111 is shaped so as to comprise a three-dimensional contour that corresponds in size and shape to the first oral care implement 130. In one embodiment, the first transparent panel 111 may be formed from a thermoformed plastic film. Suitable thermoformed plastic films may be constructed of such material as polyethylene-terephthalate (PETA, PETG, PETGAG), polyvinylchloride (PVC), polypropylene (PP) or styrol-butadiene-block copolymer (SBS), preferred PVC. Other suitable materials of construction for the thermoformed plastic film include, without limitation, renewable primary products, for example of cornstarch, sugar (polyhydroxybutyrat/-valerat), cellulose diacetate, cellulose nitrate, polyactid (PLA), and polyhydroxybutyrat (PHB).

The first backer panel 112 may, in one embodiment, be formed of a paper material such as cardboard, posterboard, other relatively thick paper products, plastic, film, combinations thereof, or other suitable material. The first backer panel 112 can be a single layer or a multi-layer laminate. The first backer panel 112 may be flexible in some embodiments, but may be rigid or semi-rigid in other embodiments. The first backer panel 112 has an upper surface 113 and an opposite lower surface 114. In the exemplified embodiment, the first backer panel 112 is illustrated as having a flat, planar upper surface 113 and a flat, planar lower surface 114. Of course, in other embodiments one or both of the upper and lower surfaces 113, 114 of the first backer panel 112 may have various contours, three-dimensional regions or the like. The first backer panel 112 may comprise product information, such as indicia that provide information to a consumer about the first oral care implement 130 that is contained within the first package 110. Such indicia may include instructions, logos, advertisements, and/or other marketing information. All or a portion of the first backer panel 112 can be opaque so that the product information can be effectively conveyed to the consumer.

In certain embodiments, the first transparent panel 111 may form a blister package so that the first transparent panel 111 forms a front cover and a rear cover of the package 110. In such an embodiment, the first backer panel 112 may be located within the cavity formed between the front and rear covers of the first transparent panel 111 alongside of the first oral care implement 130. Thus, in such an embodiment the front and rear covers of the first transparent panel 111 are coupled together to form a cavity for receiving the first oral care implement 130, and the first backer panel 112 is positioned within the cavity. In such embodiments, at least a portion of the first backer panel 112 is visible through the first transparent panel 111 due to the transparent nature of the first transparent panel 111, discussed in more detail below.

In the exemplified embodiment, the first transparent panel 111 is coupled to the first backer panel 112 so as to form a first product retaining cavity 115 between the inner surface 116 of the first transparent panel 111 and the upper surface 113 of the first backer panel 112. Thus, in the exemplified embodiment the bounds of the first product retaining cavity 115 are formed by the upper surface 113 of the first backer panel 112 and the inner surface 116 of the first transparent panel 111. In the exemplified embodiment, the first transparent panel 111 is coupled to the first backer panel 112 along a periphery or perimeter of the upper surface 113 of the first backer panel 112. The first transparent panel 111 may be coupled to the first backer panel 112 by adhesion such as glue or tape, fasteners such as screws, nails, pins, or hook-and-loop, a thermal weld, interference fit, tab, combinations thereof, or any other suitable technique as would be understood by those of skill in the art. Furthermore, in other embodiments the first transparent panel 111 may wrap around the peripheral side edges of the first backer panel 112 so that the peripheral side edges of the first backer panel 112 are trapped within a slot or channel of the first transparent panel 111. Thus, the invention is not to be limited by the manner in which the first transparent panel 111 is coupled to the first backer panel 112 in all embodiments.

As noted above, in the exemplified embodiment the first transparent panel 111 has a three-dimensional contour that corresponds in shape to the first oral care implement 130. Thus, in the first packaged oral care implement 100, the first oral care implement 130 is positioned within the first product retaining cavity 115 of the first package 110. Due to the three-dimensional contour of the first transparent panel 111, the first oral care implement 130 fits within the first product retaining cavity 115 formed between the first transparent panel 111 and the first backer panel 112. Furthermore, due to the transparent nature of the first transparent panel 111, at least a portion of the oral care implement 130 is visible from outside of the first package 110. Thus, a person viewing the first package 110 will be able to see at least a portion of the first oral care implement 130 without opening the first package 110. Although in the exemplified embodiment only one of the oral care implements is positioned within each package, the invention is not to be so limited. In other embodiments each package may be sized and shaped so as to contain two or more oral care implements therein.

As noted above, in certain embodiments the first transparent panel 111 is formed of a transparent material so that the first oral care implement 130 that is positioned within the first product retaining cavity 115 (or at least a portion thereof) is visible from an exterior of the first packaged oral care implement 100. Furthermore, in certain embodiments the entirety of the first transparent panel 111 may be transparent so that the first oral care implement 130 is visible and so that portions of the first backer panel 112 that are not covered by the first oral care implement 130 are also visible. As used herein, the term "transparent" includes materials that allow a user to see through the material, even if the material is colored or includes a small degree of translucency. In other embodiments, some portions of the first transparent panel 111 may be transparent and other portions of the first transparent panel 111 may be translucent or opaque.

Furthermore, in the exemplified embodiment the package 110 comprises a cantilevered arm 118 that forms a recess or channel 119 in the package 110. The recess or channel 119 is sized and/or shaped so that a hanging rod at a retail location can be inserted therein. When the package 110 is positioned on the hanging rod, the cantilevered arm 118 will be in surface contact with the hanging rod to hang the package 110 from the hanging rod. The bottom of the cantilevered arm 118 has an undulating surface or a surface with a plurality of indentations therein to facilitate proper cooperation between the hanging rod and the cantilevered arm 118.

The first oral care implement 130 generally comprises a first handle 131 and a first head 132 coupled to the first handle 131. Furthermore, the first oral care implement 130 comprises a first tooth cleaning element field 133 extending from the first head 132. More specifically, in the exemplified embodiment the first head 132 has a front surface 134 and an opposing rear surface 135. The first tooth cleaning element field 133 extends from the front surface 134 of the first head 132. The first oral care implement 110 may also include a tissue cleanser on the rear surface 135 of the first head 132 if desired for cleaning a user's tongue, cheeks, gums and other oral tissue surfaces.

In the exemplified embodiment, the first tooth cleaning element field 133 comprises a plurality of cleaning elements that are used for cleaning a user's teeth. As used herein, the term "cleaning elements" is used in a generic sense to refer to any structure that can be used to clean, polish or wipe the teeth and/or soft oral tissue (e.g. tongue, cheek, gums, etc.) through relative surface contact. Common examples of cleaning elements include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

The cleaning elements of the tooth cleaning element field 133 can be connected to the first head 132 in any manner known in the art. For example, staples/anchors, in-mold tufting (IMT), anchor free tufting (AFT), or combinations thereof could be used to mount the cleaning elements/tooth engaging elements to the first head 132. In certain embodiments, the invention can be practiced with various combinations of stapled, IMT or AFT bristles. In AFT, a plate or membrane is secured to the brush head such as by ultrasonic welding. The bristles extend through the plate or membrane. The free ends of the bristles on one side of the plate or membrane perform the cleaning function. The ends of the bristles on the other side of the plate or membrane are melted together by heat to be anchored in place. Any suitable form of cleaning elements may be used in the broad practice of this invention.

As will be discussed in more detail below with reference to FIGS. 4-8B, in certain embodiments the oral care implements are packaged in a package based on characteristics of the oral care implement. Thus, in certain embodiments the first tooth cleaning element field 133 has a first characteristic. Furthermore, in the exemplified embodiment the first packaged oral care implement 100 comprises a first designated area 150 on a visible surface of the first package 110. The first designated area 150, by being on a visible surface of the first package 110, is visible to a consumer who is viewing the first packaged oral care implement 100 while making a purchasing decision. The first designated area 150 is color coded with a first color that is selected to represent the first characteristic of the first oral care implement 130 positioned within the first package 110. Stated another way, the first designated area 150 has a color that, based on a color coding system in which each of a plurality of colors is indicative of a specific oral care benefit or a specific characteristic of the cleaning element field, is indicative of the oral care benefit or characteristic which the first oral care implement 130 in the first package 110 is configured to achieve. Thus, a consumer viewing the packaged oral care implement 100 can immediately recognize that the first characteristic is a feature of the first tooth cleaning element field 133 of the first oral care implement 100 simply by viewing the packaged oral care implement 100, and more particularly by viewing the first designated area 150 of the packaged oral care implement 100.

In the exemplified embodiment, the first designated area 150 is an oval shaped region on the first backer panel 112 that is color coded with a first color. The first designated area 150 is visible by virtue of the first transparent panel 111 being transparent. The first designated area 150 is positioned in a top region of the package 110, which as discussed below is a region in which the first head 132 of the first oral care implement 130 is positioned when the first oral care implement 130 is positioned within the first product retaining cavity 115 of the first package 110. Furthermore, in the exemplified embodiment the first transparent panel 111 has an oval-shaped three-dimensional region through which the portion of the first backer panel 112 that is color coded with the first color can be seen. Thus, in the exemplified embodiment, the oval-shaped three-dimensional region is aligned with the first designated area 150. In certain embodiments the oval-shaped three-dimensional region of the first transparent panel 111 may be the only portion of the first transparent panel 111 that is transparent.

Although described above and illustrated herein such that the first designated area 150 is on the upper surface 113 of the first backer panel 112, the invention is not to be so limited and in other embodiments the first designated area 150 may be a region or portion of the first transparent panel 111 that is color coded with the first color. Furthermore, although exemplified as being oval in shape, the first designated area 150 can take on any shape or pattern as desired. Thus, the first designated area 150 may be a square, rectangular, or triangular shaped (or any other shaped) region that is color coded with the first color. It is merely desired in certain embodiments that the first designated area 150 be an area of the package 110 (which can be on the first transparent panel 111 or on the first backer panel 112) that is visible to a consumer and that is color coded with a first color that is selected to represent the first characteristic of the first tooth cleaning element field 133 or the oral care benefit that the first oral care implement 130 within the first package 110 is intended to achieve.

In the exemplified embodiment, the first oral care implement 130 is positioned within the first product retaining cavity 115 of the first package 110 so that the first tooth cleaning element field 133 overlies a portion of the first designated area 150. As a result of this positioning of the first oral care implement 130 within the first package 110, the first tooth cleaning element field 133 is visible to a consumer who is viewing the first package 110 without opening the first package 110. Furthermore, in embodiments in which two or more of the oral care implements 130 are positioned within the first product retaining cavity 115 of the first package 110, the heads of both of the oral care implements 130 are positioned so as to overlie a portion of the first designated area 150. Furthermore, although illustrated herein with the first tooth cleaning element field 133 overlying a portion of the first designated area 150, the invention is not to be so limited in all embodiments. In certain other embodiments the first tooth cleaning element field 133 may be adjacent to but not overlying the first designated area 150.

In the exemplified embodiment, the entirety of the first head 132 of the first oral care implement 130 overlies at least a portion of the first designated area 150. Stated another way, a plane extending transverse to the longitudinal axis of the first oral care implement 130 will intersect both the first head 132 of the first oral care implement 130 (and the first tooth cleaning element field 133) and the first designated area 150. By positioning the first oral care implement 130 in this manner, the first color of the first designated area 150 will draw attention to the first tooth cleaning element field 133 of the first oral care implement 130. Furthermore, due to the transparency of the first transparent panel 111, the first tooth cleaning element field 133 and the first designated area 150 will both be visible to a consumer. Thus, as the first color represents the first characteristic of the first tooth cleaning element field 133, a consumer's attention will be drawn to the first tooth cleaning element field 133 and the consumer will be able to visualize the first characteristic of the first tooth cleaning element field.

Of course, the invention is not to be limited in all embodiments to positioning the first oral care implement 130 so that the first tooth cleaning element field 133 overlies a portion of the first designated area 150. In other embodiments, the first designated area 150 may be located on portions of the package 110 that are not overlapped by the first oral care implement 130. Specifically, the first designated area 150 may be a first color on the upper surface 113 of the first backer panel 112 at a location that does not intersect any portion of the first oral care implement 130. Alternatively the first designated area 150 may be a first color on the first transparent panel 111 at a location that does not intersect any portion of the first oral care implement 130. In still other embodiments, the first designated area 150 may be a first color on the lower surface 114 of the first backer panel 112. Thus, the invention is not to be limited by the location of the first designated area 150 in all embodiments, and it is merely preferred that the first designated area 150 be located on a visible surface of the first package 110 (which can be various locations on the upper or lower surfaces 114, 115 of the first backer panel 112 and various locations on the first transparent panel 111).

In some embodiments the first characteristic may be a type of bristle such that the first characteristic is selected from the group consisting of tapered bristles, charcoal bristles, spiral bristles and cylindrical or rounded bristles. Thus, by viewing the color coding on the first designated area 150 of the first package 110, a consumer can immediately be informed whether the first tooth cleaning element field 133 has tapered bristles, charcoal bristles, spiral bristles or cylindrical bristles without having to actually view the bristles. In other embodiments the characteristic may be selected from the group consisting of interdental cleaning, tooth whitening, odor adsorption, and standard cleaning. In such an embodiment, by viewing the color coding on the first designated area 150 of the first package 110, a consumer can immediately be informed whether the first tooth cleaning element field 133 is intended to be used for tooth whitening, interdental cleaning, odor adsorption, or standard cleaning. In certain embodiments, tapered bristles are used for interdental cleaning, spiral bristles are used for tooth whitening, charcoal bristles are used for odor adsorption, and cylindrical bristles are used for standard cleaning. Furthermore, as will be discussed in more detail below, the first characteristic may be that some of the bristles are one of tapered, spiral or charcoal and others of the bristles are standard bristles (i.e., cylindrical bristles) and/or elastomeric elements.

In still other embodiments, the first characteristic of the first tooth cleaning element field 133 can be that one or more cleaning elements of the first tooth cleaning element field 133 is coated or impregnated with an oral care additive that provides a proven benefit to a user's oral health. Thus, in such an embodiment the oral care implement is intended to impart a specific oral care benefit to a user. The oral care benefit may be interdental cleaning, tooth whitening or odor adsorption as discussed above, or alternatively may be a benefit that is achieved by coating or impregnating the cleaning elements with an additive. Oral care additives that may be used to impart an oral care benefit to a user include, without limitation, lotus seed; lotus flower, bamboo salt; jasmine; corn mint; camellia; aloe; gingko; tea tree oil; xylitol; sea salt; vitamin C; ginger; cactus; baking soda; pine tree salt; green tea; white pearl; black pearl; charcoal powder; nephrite or jade and Ag/Au+. Thus, depending on which of the above oral care additives is included on the first tooth cleaning element field 133, different benefits, as discussed directly below, may be achieved.

The lotus seed is the extract from lotus seeds and is a natural herb for anti-heating and the prevention of gum bleeding. The lotus flower is the extract from the lotus flower and is a natural herb for anti-heating and the prevention of gum bleeding. Bamboo salt is the combination of a bamboo extract and salt and is used to diminish inflammation and has anti-bacterial effects. Jasmine is an extract from the jasmine flower and is a natural herb for anti-heating, preventing gum bleeding and for mouth freshening. Corn mint is an extract from a corn mint leaf and is a natural herb for anti-heating, anti-bacterial uses and mouth freshening. Camellia is an extract from the camellia flower and is a natural herb for anti-heating and the prevention of gum bleeding. Aloe is an extract from the aloe leaf and is a natural herb for inflammation reduction and has anti-bacterial effects. Gingko is an extract from the gingko leaf and is a natural herb for inflammation reduction and has anti-bacterial effects. Tea tree oil is an extract from a tea tree and is a natural herb for diminishing inflammation and has anti-bacterial effects. Xylitol is an extract from plants such as corn, sugar cane, oak, birch, etc. and can be used for preventing tooth decay. Sea salt is an extract from the sea and can be used to reduce inflammation and has anti-bacterial effects. Vitamin C is an extract from food and can be used to prevent gum bleeding and as an antioxidant. Ginger is an extract from ginger and is a natural plant for diminishing inflammation and has anti-bacterial effects. Cactus is an extract from a cactus and it a natural plant for reducing inflammation and can be used as an antioxidant. Backing soda is a chemistry product and can be used as an enamel protectant. Pine tree salt is a mixture of the extract from pine trees and salt and is an ancient Chinese medicine for preventing inflammation and anti-heating. Green tea is an extract from the green tea leaf and is a natural herb to prevent halitosis and inhibit bacteria growth. White pearl is a type of pearl powder and can be used for teeth whitening and teeth health improvement by calcium absorption. Black pearl is a kind of pearl powder that can be used for teeth whitening, cleaning and stain removal. Charcoal is made from an oak tree by carbonization and it helps with moisture adjustment and to reduce the growth of bacteria. Nephrite (jade) is a type of nephrite powder and can be used to prevent gum disease and boost the blood circulation of the gums. Ag/Au is an anti-bacterial additive contained in the Ag/Au ion (i.e., silver/gold) and can be used to inhibit bacterial growth. In certain embodiments, each of the first and second oral care additives are selected from a group consisting of a mixture of pine tree extract and salt, a tea leaf extract, a pearl powder, a nephrite powder, a charcoal powder, and an antibacterial material. In some embodiments, the oral care additives are natural ingredients.

Although described herein above with regard to the characteristics that are indicated by the color coding being either bristle type, preferred use, or additive, in other embodiments the characteristics may be related to the handle, the grip, the size, the age range for use, or the like of the particular oral care implement in the package. Thus, in certain embodiments the oral care implement 130 may have a portion having one of a plurality of different characteristics and the package within which that particular oral care implement 130 is positioned will have a designated area having a color that is indicative of the characteristic which the oral care implement 130 within that package has. Thus, the designated area may be colored to indicate whether or not the handle has an elastomeric thumb grip, the designated area may be colored to indicate the age of a person for which the oral care implement is suitable, the designated area may be colored to indicate the size of the handle or of the head, the designated area may be colored to indicate the length of the bristles, or the designated area may be colored to indicate other characteristics of other portions of the oral care implement. Thus, the color coding techniques described herein are not limited to indicating bristle types, but can be used to indicate any characteristic of any portion of the oral care implements.

Figure 4:
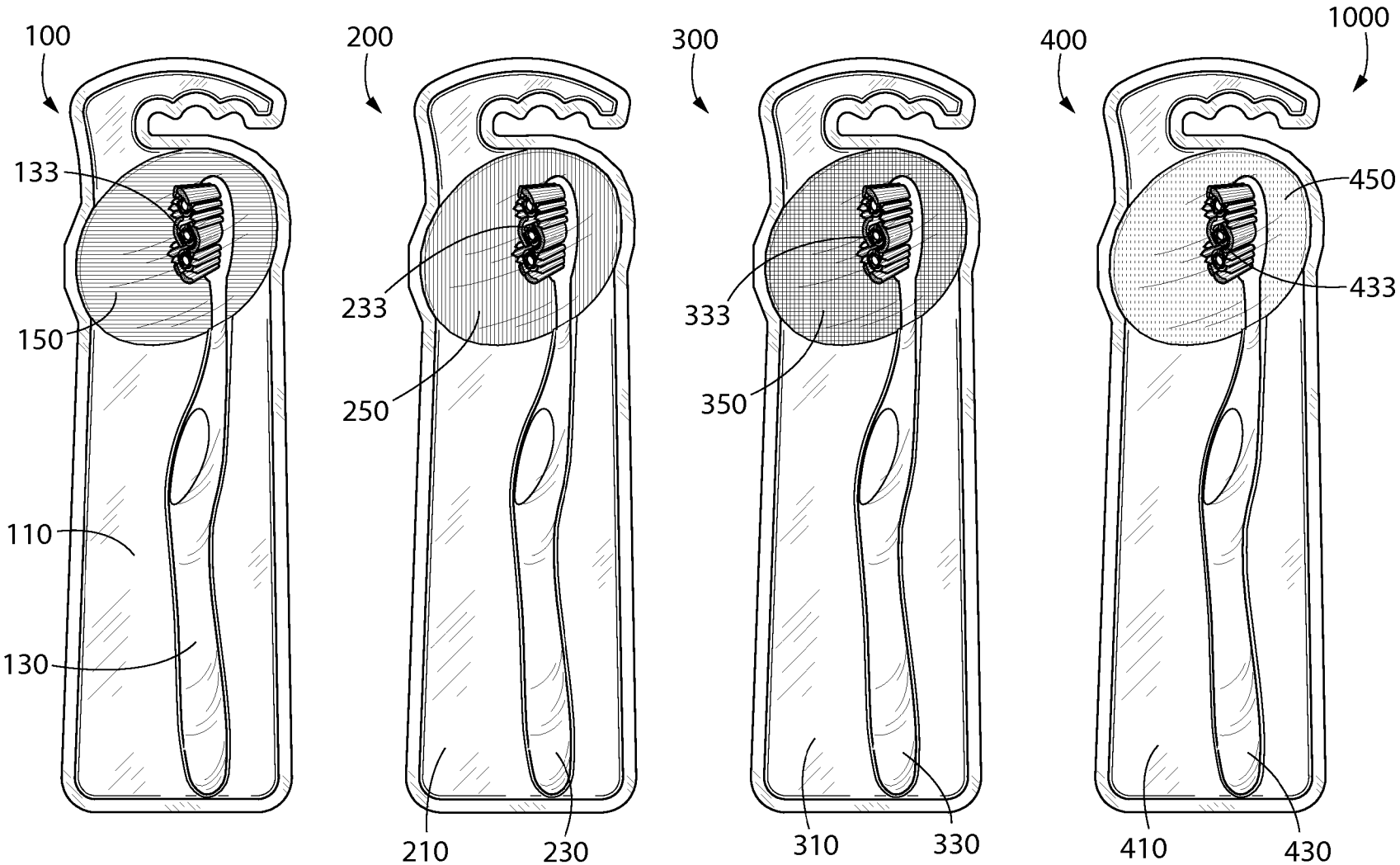
FIG. 4 is a front view of a color coded oral care implement packaging system including four of the packaged oral care implements of FIG. 1, each of the four packaged oral care implements having a color coded designated area.

Referring now to FIG. 4, a color coded oral care implement packaging system 1000 will be described. The color coded oral care implement packaging system 1000 comprises the first packaged oral care implement 100, a second packaged oral care implement 200, a third packaged oral care implement 300, and a fourth packaged oral care implement 400. As noted above, the structure of each of the first, second, third, and fourth packaged oral care implements 100, 200, 300, 400 is identical. The first packaged oral care implement 100 comprises the first package 110 and the first oral care implement 130. The second packaged oral care implement 200 comprises a second package 210 and a second oral care implement 230. The third packaged oral care implement 300 comprises a third package 310 and a third oral care implement 330. The fourth packaged oral care implement 400 comprises a fourth package 410 and a fourth oral care implement 430.

The differences between each of the first, second, third and fourth packaged oral care implements 100, 200, 300, 400 is that the first oral care implement 130 comprises the first tooth cleaning element field 133 having the first characteristic, the second oral care implement 230 comprises a second tooth cleaning element field 233 having a second characteristic, the third oral care implement 330 comprises a third tooth cleaning element field 333 having a third characteristic, and the fourth oral care implement 430 comprises a fourth tooth cleaning element field 433 having a fourth characteristic. In the exemplified embodiment, each of the first, second, third, and fourth characteristics is a different characteristic. Thus, the first characteristic may be that the first tooth cleaning element field 133 comprises cylindrical or rounded bristles or are intended to be used for a standard clean. The second characteristic may be that the second tooth cleaning element field 233 comprises spiral bristles or are intended to be used for tooth whitening. The third characteristic may be that the third tooth cleaning element field 333 comprises charcoal bristles or are intended to be used for odor adsorption. The fourth characteristic may be that the fourth tooth cleaning element field 433 comprises tapered bristles or are intended to be used for interdental cleaning. Of course, any of the other characteristics, such as the benefits achieved by using different oral care additives on the tooth cleaning element field can also be imparted to one of the tooth cleaning element fields. Furthermore, as discussed above the characteristics may be unrelated to the cleaning element field and may be an appropriate age range for use of the various oral care implements, different configurations or features of the handle, different sizes of the oral care implement or head thereof, or the like.

Furthermore, as discussed above the first designated area 150 on the first package 110 is color coded with the first color to represent the first characteristic of the first tooth cleaning element field 133. In the exemplified embodiment, the pattern of lines illustrated within the first designated area 150 is intended to indicate that the first color is blue. Thus, in the exemplified embodiment the color blue being visible in the first designated area 150 indicates that the first tooth cleaning element field 133 has the characteristic of having standard or cylindrical bristles or of being used for standard or conventional-type cleanings. Of course, the first color can be any desired color, it merely being preferable in some embodiments that each of the first, second, third, and fourth colors are different to properly and readily distinguish the first, second, third, and fourth characteristics. Furthermore, the first characteristic can be any of the other characteristics noted above including those achieved by coating or impregnating the cleaning elements with an additive, it merely being preferable in some embodiments that each of the first, second, third, and fourth characteristics are different.

The second designated area 250 on the second package 210 is color coded with a second color to represent the second characteristic of the second tooth cleaning element field 133. In the exemplified embodiment, the pattern of lines illustrated within the second designated area 250 is intended to indicate that the second color is red. Thus, in the exemplified embodiment the color red being visible in the second designated area 250 indicates that the second tooth cleaning element field 233 has the characteristic of having spiral bristles or of being used for tooth whitening. Of course, the second color can be any desired color in other embodiments and the second characteristic can be any of the other characteristics discussed above including those achieved by coating or impregnating the cleaning elements with an additive.

The third designated area 350 on the third package 310 is color coded with a third color to represent the third characteristic of the third tooth cleaning element field 333. In the exemplified embodiment, the pattern of lines illustrated within the third designated area 350 is intended to indicate that the third color is black. Thus, in the exemplified embodiment the color black being visible in the third designated area 350 indicates that the third tooth cleaning element field 333 has the characteristic of having charcoal bristles or of being used for odor adsorption. Of course, the third color can be any desired color in other embodiments and the third characteristic can be any of the other characteristics discussed above including those achieved by coating or impregnating the cleaning elements with an additive.

The fourth designated area 450 on the fourth package 410 is color coded with a fourth color to represent the fourth characteristic of the fourth tooth cleaning element field 433. In the exemplified embodiment, the pattern of lines illustrated within the fourth designated area 450 is intended to indicate that the fourth color is purple. Thus, in the exemplified embodiment the color purple being visible in the fourth designated area 450 indicates that the fourth tooth cleaning element field 433 has the characteristic of having tapered bristles or of being used for interdental cleaning. Of course, the fourth color can be any desired color in other embodiments and the fourth characteristic can be any of the other characteristics discussed above including those achieved by coating or impregnating the cleaning elements with an additive.

Thus, in certain embodiments the invention is directed to the first packaged oral care implement 100 comprising the first package 110 and the first oral care implement 130 therein. In such embodiment the first oral care implement 130 comprises the first tooth cleaning element field 133 having the first characteristic. Furthermore, the package 110 includes the first designated area 150, which is color coded with a first color selected to represent the first characteristic. The invention also includes the second packaged oral care implement 100 comprising the second package 210 and the second oral care implement 230 therein. The second oral care implement 230 comprises the second tooth cleaning element field 233 having the second characteristic. Furthermore, the second package 210 includes the first designated area 250, which is color coded with a second color selected to represent the first characteristic. In certain embodiments, the second color is a different color than the first color.

In certain embodiments, the first characteristic may be a first type of bristles and the second characteristic may be a second type of bristles. Furthermore, the first type of bristles may be selected from the group consisting of tapered bristles, charcoal bristles, and spiral bristles. The second type of bristles may also be selected from the group consisting of tapered bristles, charcoal bristles, and spiral bristles. Alternatively or additionally, the first and second characteristics may be different and may each be selected from the group consisting of tooth whitening, interdental cleaning, and odor adsorption. Of course, third and fourth packaged oral care implements 300, 400 (and more if desired) can also form a part of the invention herein in some embodiments.

Figure 5A:
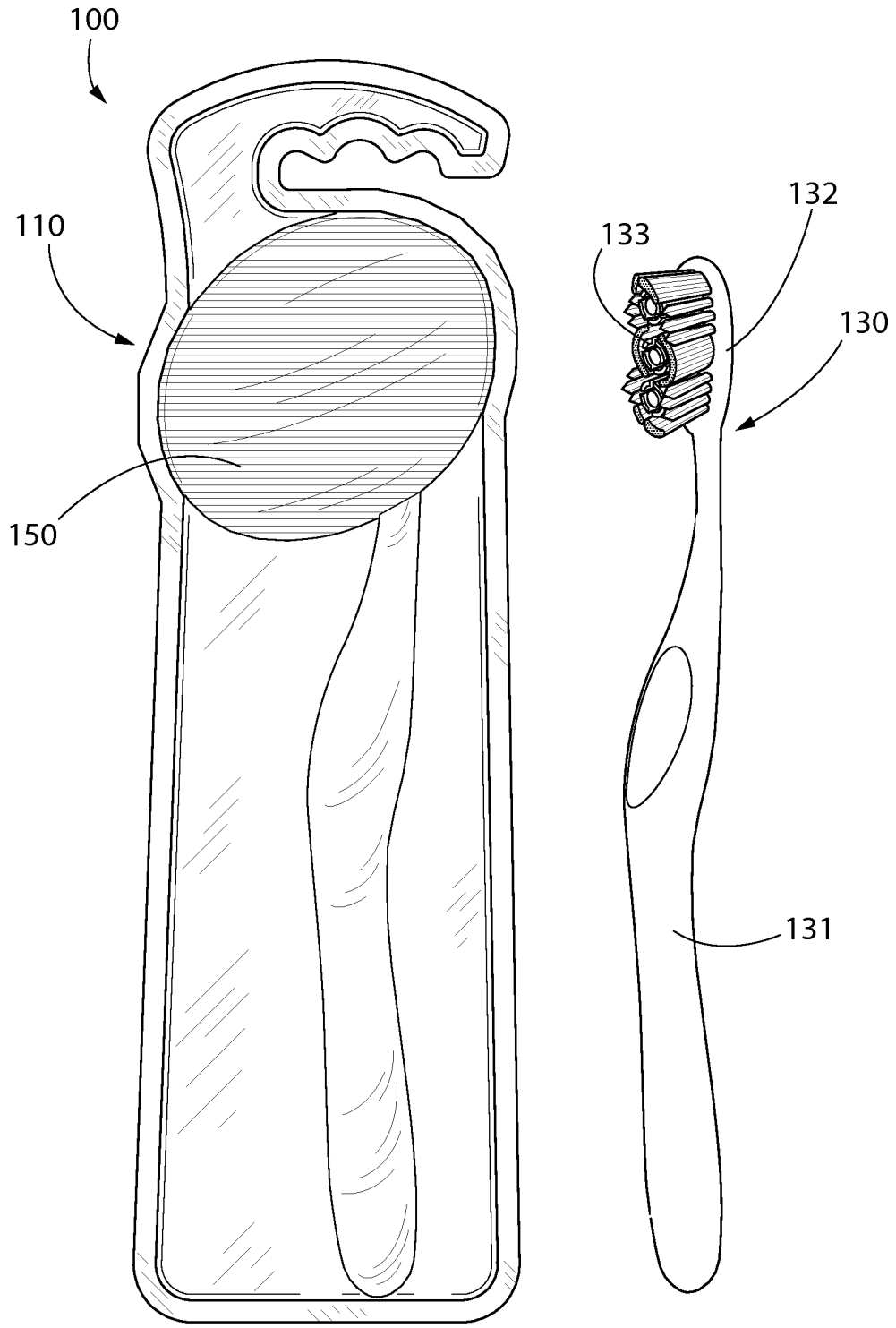
FIG. 5A is a front view of a first one of the packaged oral care implements of FIG. 4 with the first oral care implement removed from the first package.
Figure 5B:
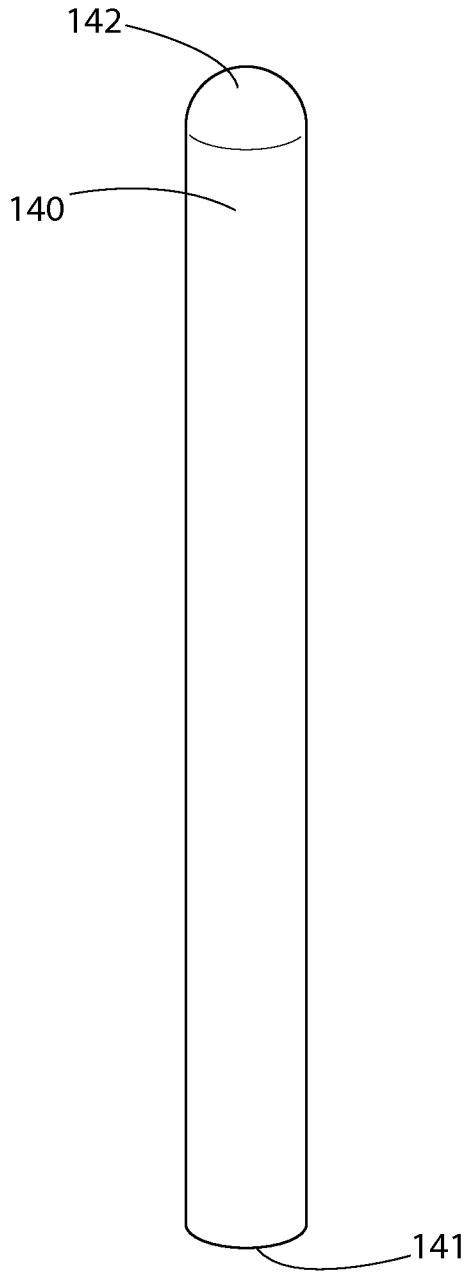
FIG. 5B is a close-up view of one of the tooth cleaning elements of the first oral care implement of FIG. 5A.

Referring now to FIGS. 5A and 5B concurrently, the details of the first packaged oral care implement 100 and its components and features will be described in accordance with an embodiment of the present invention. In FIG. 5A, the first packaged oral care implement 100 is illustrated with the first oral care implement 130 separated from the first package 110. In FIG. 5B, one of the bristles 140 of the first tooth cleaning element field 133 is illustrated. As discussed above, the first tooth cleaning element field 133 has a first characteristic.

The first tooth cleaning element field 133 comprises a plurality of tufts of bristles and may also include some elastomeric elements. Each of the tufts of bristles comprises a plurality of individual bristles that are clustered together into a tuft and then secured to a tuft hole of the first head 132 of the first oral care implement 130 in any of the manners discussed herein above. As one example which has been discussed above, the first characteristic of the first tooth cleaning element field 133 may be that at least some of the bristles of the first cleaning element field 133 are cylindrical and/or rounded bristles or that the bristles are intended to be used for a standard or conventional cleaning. Thus, the first tooth cleaning element field 133 comprises tufts of bristles that include cylindrical or rounded bristles, such as the bristle 140 depicted in FIG. 5B.

The bristle 140 extends from a bottom end 141, which is the end that would be inserted into the tuft hole on the first head 132, to a cleaning end 142. The bristle 140 has a cylindrical shape and the cleaning end 142 is rounded. The bristle 140 is a conventional cylindrical bristle used on oral care implements. When the first designated area 150 is colored with the first color, a consumer will be automatically informed (possibly with the use of a color code key, as discussed in more detail below with regard to FIG. 9) that the first tooth cleaning element field 133 includes cylindrical and/or rounded bristles that are used for standard tooth cleaning.

It should be appreciated that in some embodiments, the use of the first color in the first designated area 150 may indicate that all of the tooth cleaning elements in the first tooth cleaning element field 133 have the first characteristic (are cylindrical and/or rounded). However, in other embodiments the use of the first color in the first designated area 150 may indicate that one or more of the bristles of the first tooth cleaning element field 133 has the first characteristic (is cylindrical and/or rounded), but not necessarily that all of the bristles of the first tooth cleaning element field 133 have the first characteristic. Furthermore, although described herein with the first characteristic being that the bristles are cylindrical, the invention is not to be so limited and the first characteristic can be any of the characteristics or benefits discussed herein. It is merely the case that the first color of the first designated area 150 is indicative of the first characteristic or first benefit of the first tooth cleaning element field 133 (or other portion of the first oral care implement 130), regardless of what the first color is and of what the first characteristic or first benefit is.

Figure 6A:
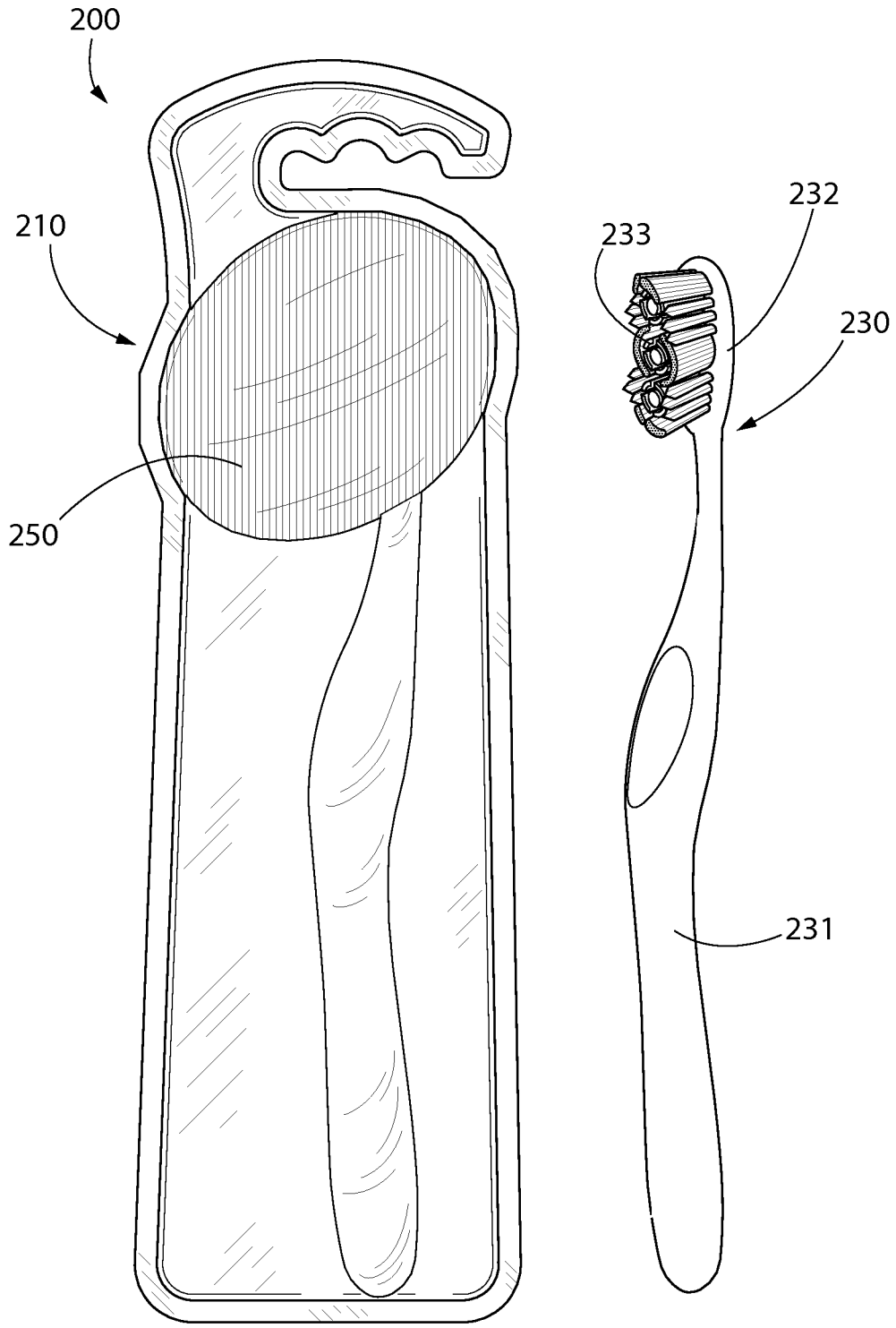
FIG. 6A is a front view of a second one of the packaged oral care implements of FIG. 4 with the second oral care implement removed from the second package.
Figure 6B:
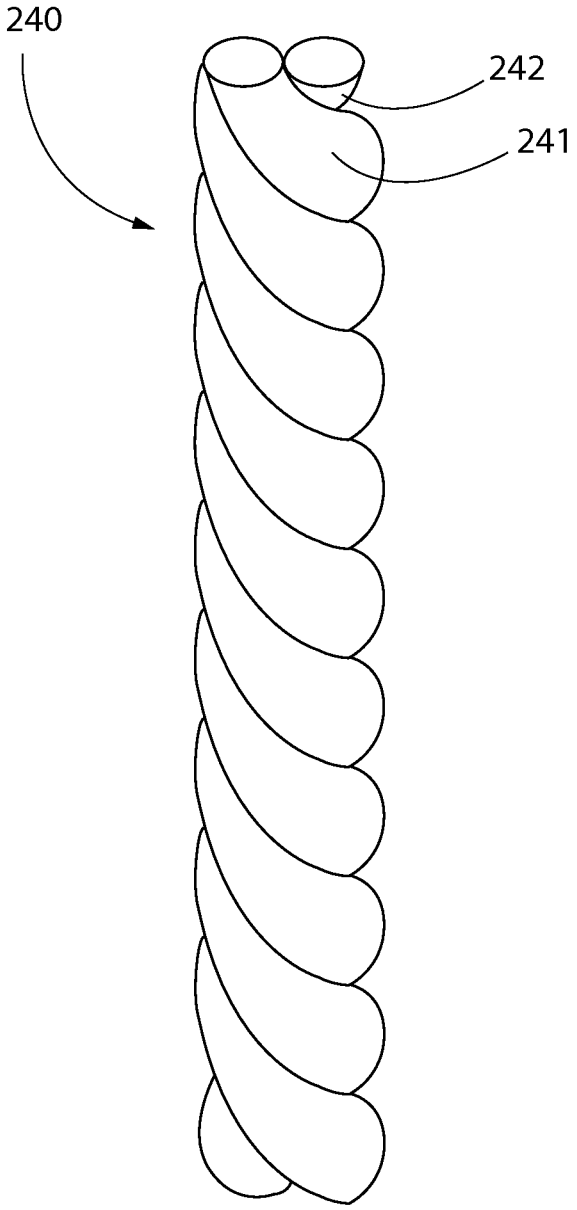
FIG. 6B is a close-up view of one of the tooth cleaning elements of the second oral care implement of FIG. 6A.

Referring now to FIGS. 6A and 6B concurrently, the details of the second packaged oral care implement 200 and its components and features will be described in accordance with an embodiment of the present invention. In FIG. 6A, the second packaged oral care implement 200 is illustrated with the second oral care implement 230 separated from the second package 210. In FIG. 6B, one of the bristles 240 of the second tooth cleaning element field 233 is illustrated. As discussed above, the second tooth cleaning element field 233 has a second characteristic.

The second tooth cleaning element field 233 comprises a plurality of tufts of bristles and may also include some elastomeric elements. Each of the tufts of bristles comprises a plurality of individual bristles that are clustered together into a tuft and then secured to a tuft hole of the second head 232 of the second oral care implement 230 in any of the manners discussed herein above. As one example which has been discussed above, the second characteristic of the second tooth cleaning element field 233 may be that at least some of the bristles are spiral bristles or that some of the bristles are intended to be used for tooth whitening application. Thus, the second tooth cleaning element field 233 comprises tufts of bristles that include spiral bristles, such as the bristle 240 depicted in FIG. 6B. The spiral bristle 240 is formed by a first strand 241 and a second strand 242 that are intertwined together or wound around one another to form a spiral as depicted in FIG. 6B. When the second designated area 250 is colored with the second color, a consumer will be automatically informed (possibly with the use of a color code key, as discussed in more detail below with regard to FIG. 9) that the second tooth cleaning element field 233 includes spiral bristles that are used for tooth whitening.

It should be appreciated that in some embodiments, the use of the second color in the second designated area 250 may indicate that all of the tooth cleaning elements in the second tooth cleaning element field 233 have the second characteristic (are spiral bristles). However, in other embodiments the use of the second color in the second designated area 250 may indicate that one or more of the bristles of the second tooth cleaning element field 233 has the second characteristic (spiral bristle), but not necessarily that all of the bristles of the second tooth cleaning element field 233 have the second characteristic. Furthermore, although described herein with the second characteristic being that the bristles are spiral, the invention is not to be so limited and the second characteristic can be any of the characteristics or benefits discussed herein. It is merely the case that the second color of the second designated area 250 is indicative of the second characteristic or second benefit of the second tooth cleaning element field 233 (or other portion of the second oral care implement 230), regardless of what the second color is and of what the second characteristic or second benefit is.

Figure 7A:
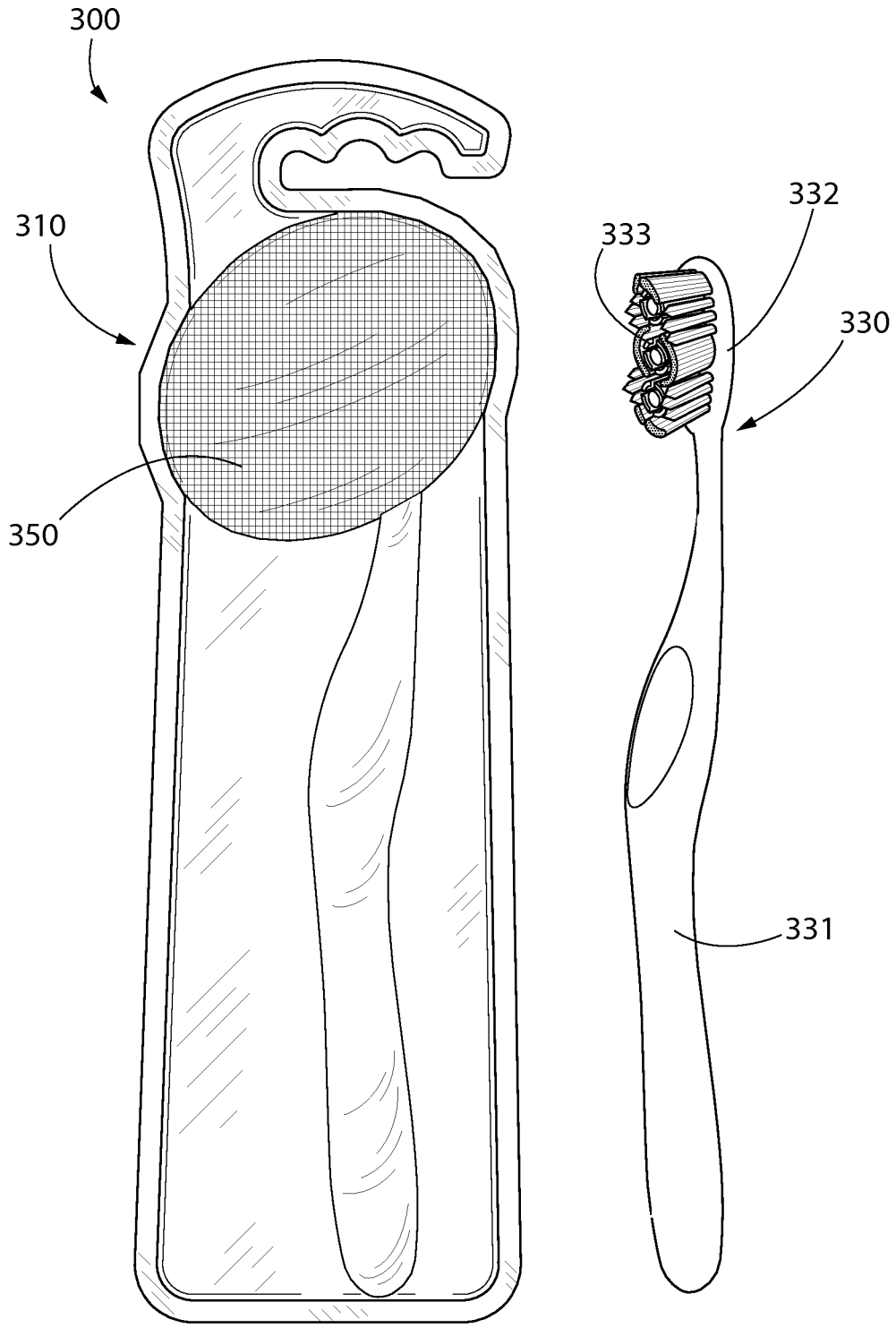
FIG. 7A is a front view of a third one of the packaged oral care implements of FIG. 4 with the third oral care implement removed from the third package.
Figure 7B:
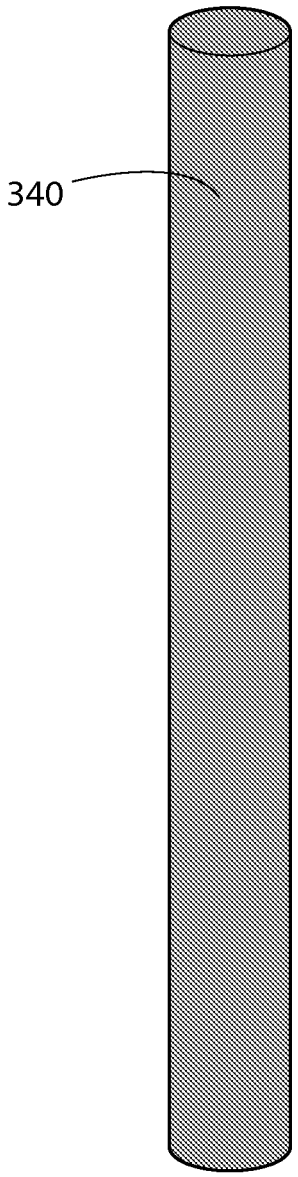
FIG. 7B is a close-up view of one of the tooth cleaning elements of the third oral care implement of FIG. 7A.

Referring now to FIGS. 7A and 7B concurrently, the details of the third packaged oral care implement 300 and its components and features will be described in accordance with an embodiment of the present invention. In FIG. 7A, the third packaged oral care implement 300 is illustrated with the third oral care implement 330 separated from the third package 310. In FIG. 7B, one of the bristles 340 of the third tooth cleaning element field 333 is illustrated. As discussed above, the third tooth cleaning element field 333 has a third characteristic.

The third tooth cleaning element field 333 comprises a plurality of tufts of bristles and may also include some elastomeric elements. Each of the tufts of bristles comprises a plurality of individual bristles that are clustered together into a tuft and then secured to a tuft hole of the third head 332 of the third oral care implement 330 in any of the manners discussed herein above. As one example which has been discussed above, the third characteristic of the third tooth cleaning element field 333 may be that at least some of the bristles are charcoal bristles or that some of the bristles are intended to be used for odor adsorption. Thus, the third tooth cleaning element field 333 comprises tufts of bristles that include charcoal bristles, such as the bristle 340 depicted in FIG. 7B.

The charcoal bristles 340 are indicated as such in the figures by using grayscale shading. The charcoal bristles 340 may be formed by mixing charcoal powder with nylon or any other material that is used to form the bristle prior to hardening and formation thereof. The charcoal bristles 340 may be formed from synthetic fibers into which activated carbon particles of charcoal are incorporated. Alternatively, the charcoal bristles 340 may be formed by coating or impregnating a bristle with charcoal in any form, including charcoal powder. When the third designated area 350 is colored with the third color, a consumer will be automatically informed (possibly with the use of a color code key, as discussed in more detail below with regard to FIG. 9) that the third tooth cleaning element field 333 includes charcoal bristles that are used for odor adsorption.

It should be appreciated that in some embodiments, the use of the third color in the third designated area 350 may indicate that all of the tooth cleaning elements in the third tooth cleaning element field 333 have the third characteristic (are charcoal bristles). However, in other embodiments the use of the third color in the third designated area 350 may indicate that one or more of the bristles of the third tooth cleaning element field 333 has the third characteristic (charcoal bristle), but not necessarily that all of the bristles of the third tooth cleaning element field 333 have the third characteristic. Furthermore, although described herein with the third characteristic being that the bristles are charcoal, the invention is not to be so limited and the third characteristic can be any of the characteristics or benefits discussed herein. It is merely the case that the third color of the third designated area 350 is indicative of the third characteristic or third benefit of the third tooth cleaning element field 333 (or other portion of the third oral care implement 330), regardless of what the third color is and of what the third characteristic or third benefit is.

Figure 8A:
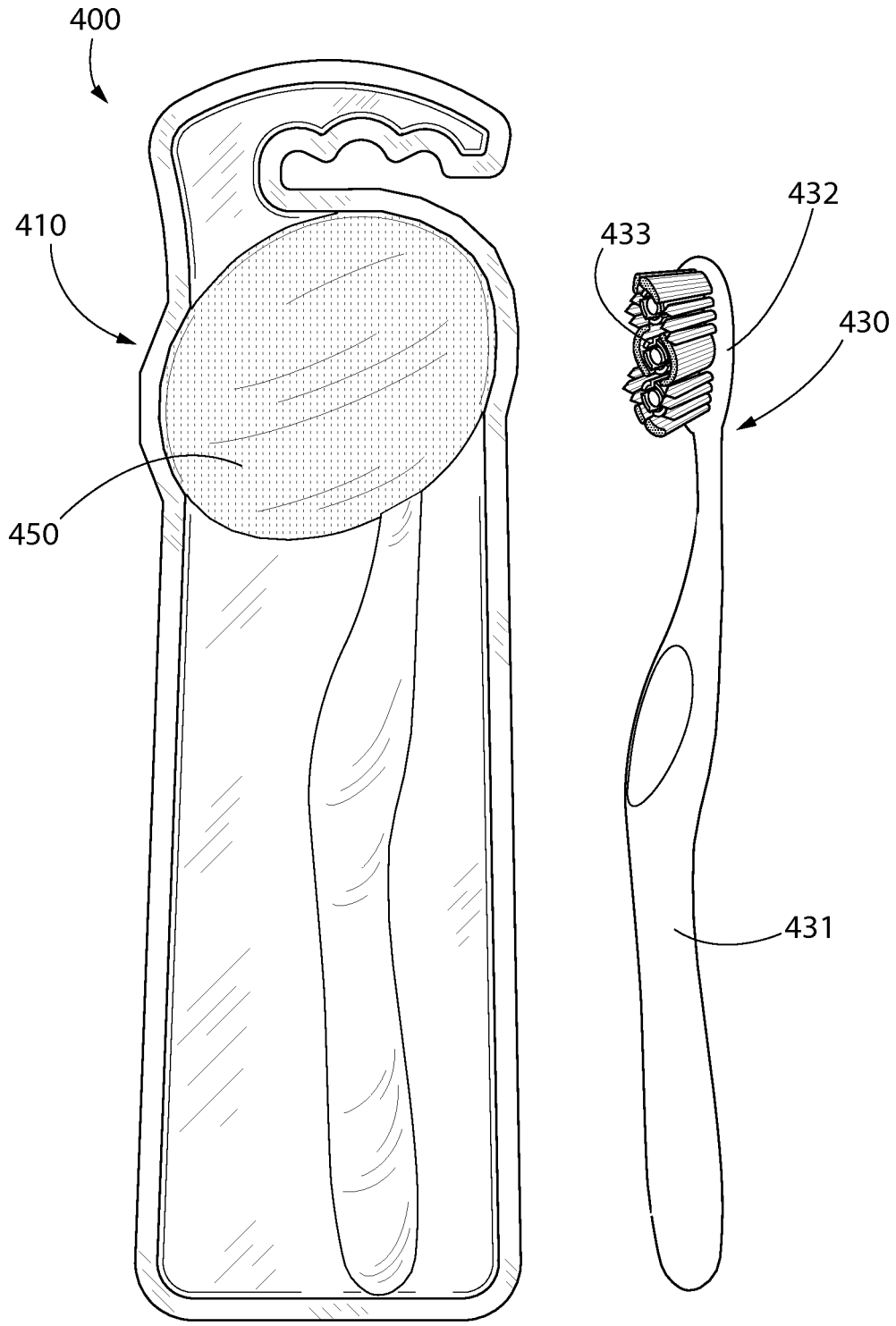
FIG. 8A is a front view of a fourth one of the packaged oral care implements of FIG. 4 with the fourth oral care implement removed from the fourth package.
Figure 8B:
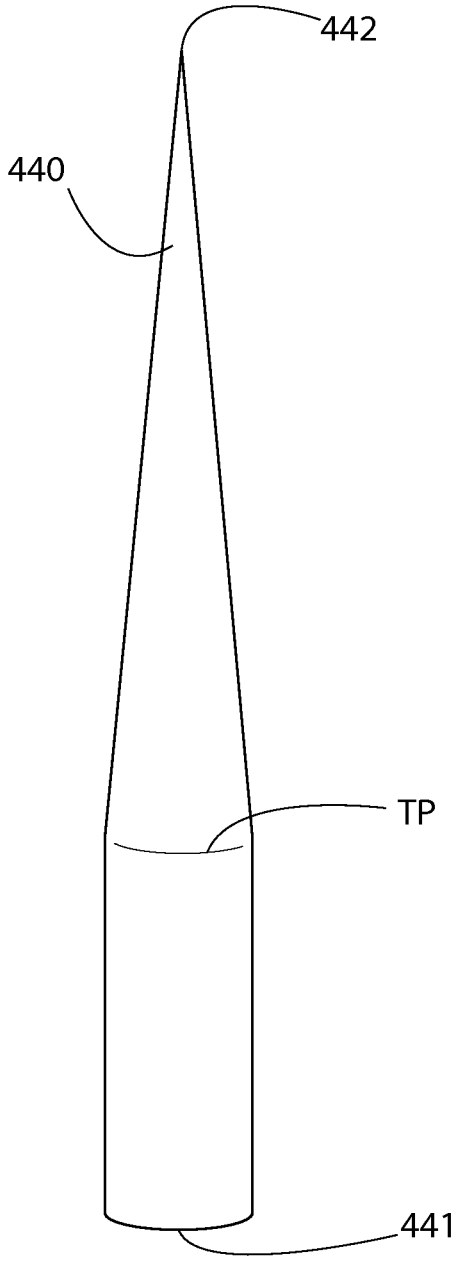
FIG. 8B is a close-up view of one of the tooth cleaning elements of the fourth oral care implement of FIG. 8A.

Referring now to FIGS. 8A and 8B concurrently, the details of the fourth packaged oral care implement 400 and its components and features will be described in accordance with an embodiment of the present invention. In FIG. 8A, the fourth packaged oral care implement 400 is illustrated with the fourth oral care implement 430 separated from the fourth package 410. In FIG. 8B, one of the bristles 440 of the fourth tooth cleaning element field 433 is illustrated. As discussed above, the fourth tooth cleaning element field 433 has a fourth characteristic.

The fourth tooth cleaning element field 433 comprises a plurality of tufts of bristles and may also include some elastomeric elements. Each of the tufts of bristles comprises a plurality of individual bristles that are clustered together into a tuft and then secured to a tuft hole of the fourth head 432 of the fourth oral care implement 430 in any of the manners discussed herein above. As one example which has been discussed above, the fourth characteristic of the fourth tooth cleaning element field 433 may be that at least some of the bristles are tapered bristles or that some of the bristles are intended to be used for interdental cleaning. Thus, the fourth tooth cleaning element field 433 comprises tufts of bristles that include tapered bristles, such as the bristle 440 depicted in FIG. 8B. The tapered bristle 440 is formed by tapering the bristle 440 to a pointed tip. Specifically, the tapered bristle 440 extends from a bottom end 441 to a top cleaning end 442. The tapered bristle 440 has a cylindrical shape from the bottom end 441 to a transition point TP. From the transition point TP to the cleaning end 442 the bristle 440 gradually tapers such that the cleaning end 442 forms a tip. The tapered bristle 440 may be tapered using chemical dipping processes or using mechanical grinding techniques. When the fourth designated area 450 is colored with the fourth color, a consumer will be automatically informed (possibly with the use of a color code key, as discussed in more detail below with regard to FIG. 9) that the fourth tooth cleaning element field 433 includes tapered bristles that are used for interproximal cleaning.

It should be appreciated that in some embodiments, the use of the fourth color in the fourth designated area 250 may indicate that all of the tooth cleaning elements in the fourth tooth cleaning element field 433 have the fourth characteristic (are tapered bristles). However, in other embodiments the use of the fourth color in the fourth designated area 450 may indicate that one or more of the bristles of the fourth tooth cleaning element field 433 has the fourth characteristic (tapered bristle), but not necessarily that all of the bristles of the fourth tooth cleaning element field 433 have the fourth characteristic. Furthermore, although described herein with the fourth characteristic being that the bristles are tapered, the invention is not to be so limited and the fourth characteristic can be any of the characteristics or benefits discussed herein. It is merely the case that the fourth color of the fourth designated area 450 is indicative of the fourth characteristic or fourth benefit of the fourth tooth cleaning element field 433 (or other portion of the fourth oral care implement 430), regardless of what the fourth color is and of what the fourth characteristic or fourth benefit is.

Figure 9:
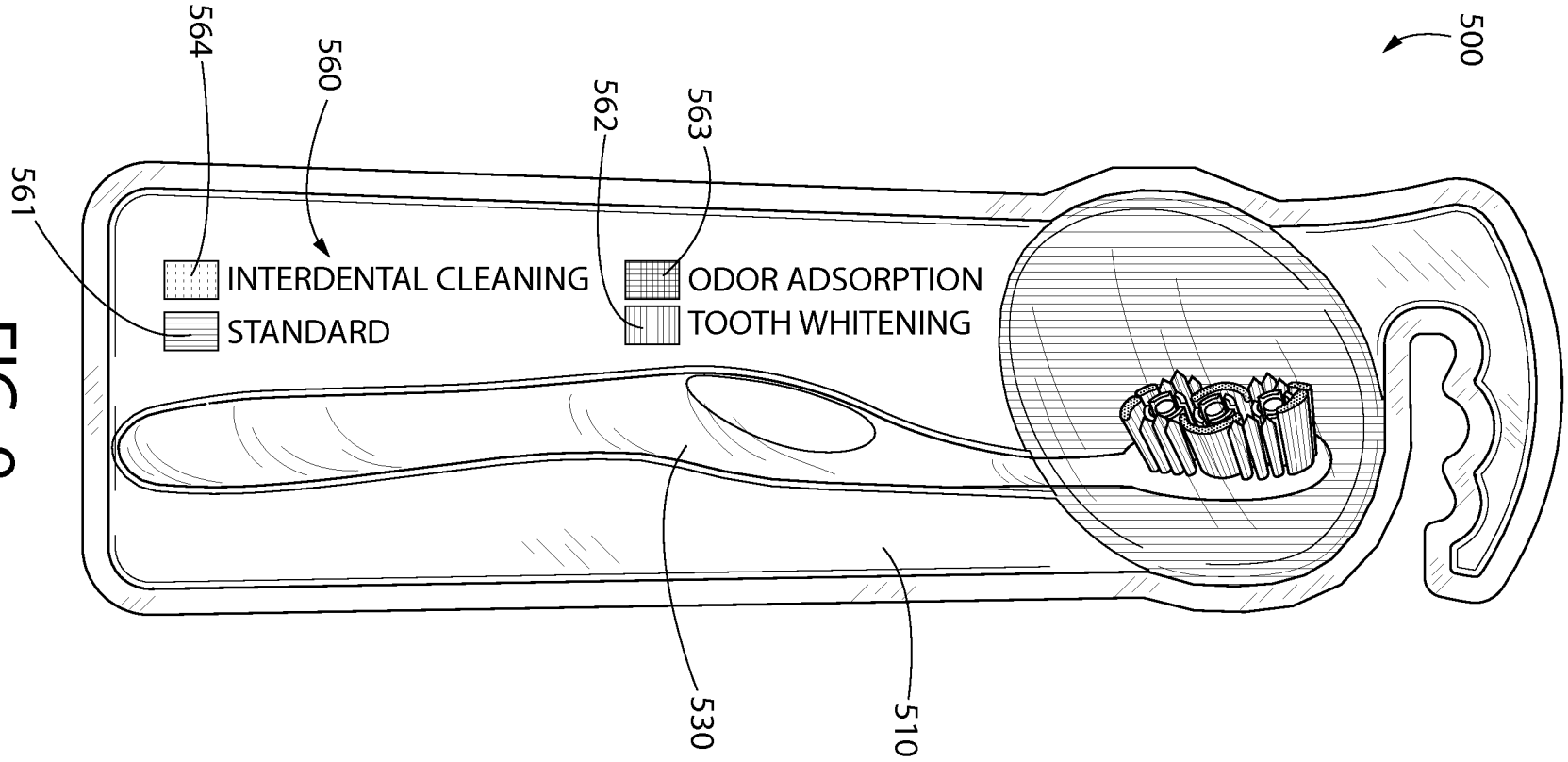
FIG. 9 is a front view of a packaged oral care implement having a color code key thereon.

Referring now to FIG. 9, a packaged oral care implement 500 will be described in accordance with the present invention. The packaged oral care implement 500 comprises a package 510 and an oral care implement 530 similar to the first through fourth packaged oral care implements 100, 200, 300, 400 discussed above. However, the package 510 of the packaged oral care implement 500 includes a color code key 560 that has graphical portions that link the colors to the characteristics. In certain embodiments, each one of the packages 110, 210, 310, 410 includes the color code key 560 depicted on the package 510 as described herein below.

The color code key 560 is a visual key that provides a visual indication to a consumer as to what characteristic each color is associated with. Thus, the color code key 560 includes a first graphical portion 561, which in this embodiment is indicating the color blue. The first graphical portion 561 indicates that when the color of the designated area 550 of the package 510 is blue, the characteristic of the oral care implement 530 in the package 510 is that the bristles are cylindrical or rounded or that the tooth cleaning element field 533 is intended for standard cleaning. The color code key 560 includes a second graphical portion 562, which in this embodiment is indicating the color red. The second graphical portion 562 indicates that when the color of the designated area 550 of the package 510 is red, the characteristic of the oral care implement 530 in the package 510 is that the bristles are spiral or that the tooth cleaning element field 533 is intended for tooth whitening. The color code key 560 includes a third graphical portion 563, which in this embodiment is indicating the color black. The third graphical portion 563 indicates that when the color of the designated area 550 of the package 510 is black, the characteristic of the oral care implement 530 in the package 510 is that the bristles are charcoal bristles or that the tooth cleaning element field 533 is intended for odor adsorption. The color code key 560 includes a fourth graphical portion 564, which in this embodiment is indicating the color purple. The fourth graphical portion 564 indicates that when the color of the designated area 550 of the package 510 is purple, the characteristic of the oral care implement 530 in the package 510 is that the bristles are tapered or that the tooth cleaning element field 530 is intended for interdental cleaning. Of course, the invention is not to be limited to the specific colors noted herein and any other colors can be used so long as the colors in the color code key 560 and their associated characteristics match with the colors in the designated areas on the packages as discussed herein.

In the embodiment exemplified in FIG. 9, the color code key 560 is located on the upper surface of the backer panel and is visible through the transparent panel. However, the color code key 560 may be located on the lower surface of the backer panel (i.e., the rear of the package 510) in other embodiments or at any other desired location so long as the color code key 560 is visible to a consumer who is attempting to determine which oral care implement to purchase based on the characteristics of the oral care implements.

Thus, the present invention provides a color coded oral care implement packaging system that enables a consumer to easily and readily determine the characteristics or benefits of a particular oral care implement that is packaged in a particular package. Specifically, simply by looking at the package, the consumer can visualize a color that is provided on the package. The user can then compare that color with the color code key 560 to determine which characteristic of the tooth cleaning element field or which oral care benefit is provided by the oral care implement provided in that particular package. The color coded oral care implement packaging system can be beneficial for use with a line of products that have a similar appearance, but that impart different benefits to a consumer during use. In the present invention, the oral care implements 130, 230, 330, 430 all have a similar appearance, but each has bristles with different characteristics (tapered, spiral, charcoal, cylindrical) or each has bristles that are coated with a different agent. The color coded oral care implement packaging system provides a quick and simple way to inform the consumer of the particular benefits of each oral care implemtype ofent in the line of products.

Referring now to FIG. 10, a color coded oral care product packaging system 2000 is illustrated in accordance with an embodiment of the present invention. The oral care product packaging system 2000 includes a plurality of packages, each of which contains at least one of a plurality of oral care products. Specifically, in the exemplified embodiment the oral care product packaging system 2000 comprises a first package 2100 containing an oral care implement or toothbrush 2110, a second package 2200 containing a mouthwash solution (not visible), and a third package 2300 containing a toothpaste or dentifrice (or a tube containing toothpaste or dentifrice) 2310. Although described and illustrated herein with an oral care implement, a mouthwash, and a dentifrice, different or additional oral care products can be included in the oral care system 2000 by including the features discussed herein. Thus, the oral care products described herein are exemplary only and the oral care product packaging system 2000 is not limited to only the oral care products described herein.

The oral care product packaging system 2000 includes a color coding system comprising a plurality of colors just as described above. Thus, the color of the color coding system that is used to indicate each of the products is indicative of an oral care benefit which the oral care product is configured to achieve. In the exemplified embodiment, the first package 2100 comprises, on a visible area, a first designated area 2150 having a first color. The second package 2200 comprises, on a visible area, a second designated area 2250 having the first color. The third package 2300 comprises, on a visible area, a third designated area 2350 having the first color. Thus, each of the first, second, and third packages 2100, 2200, 2300 has the same first color on its respective designated area 2150, 2250, 2350. In certain embodiments, a particular toothbrush, a specific mouthwash, and a specific dentifrice are intended by the manufacturer to be used together in order to achieve the most beneficial use of those products. By color coding the first, second, and third packages 2100, 2200, 2300 with the same color, a consumer can readily determine that the products contained within each of the first, second, and third products, 2100, 2200, 2300 are intended to be used together to optimize the benefits of each.

To further indicate to the consumer that the color coding is indicative of a linking feature for the various products, in the exemplified embodiment each of the first, second, and third designated areas 2150, 2250, 2350 has the same shape. Thus, the first designated area 2150 is an oval shape as has been discussed throughout the application above. Furthermore, the second designated area 2250 is provided as an oval shaped area on a label 2251 that is provided on the second package 2200. Similarly, the third designated area 2350 is provided as an oval shaped area on the outside of the third package 2300. Thus, providing each of the first, second, and third designated areas 2150, 2250, 2350 with the same shape will further indicate that these products have benefits when used together. Of course, the shape can be other than oval in other embodiments. Furthermore, in some embodiments the first, second, and third designated areas 2150, 2250, 2350 need not have the same shape, but simply by having the same color in each of the first, second, and third designated areas 2150, 2250, 2350 regardless of the shape of those designated areas a consumer will understand the liking feature between the products. Furthermore, one or more of the first, second, and third packages 2100, 2200, 2300 may include a color code key similar to that which was discussed herein above with reference to FIG. 9. Moreover, it should be appreciated that any of the specific structures and features discussed above with reference to FIGS. 1-8 are applicable to the first package 2100 of the oral care system 2000.

As one specific example, in one embodiment the color coding on the first, second, and third designated areas 2150, 2250, 2350 may indicate that the particular products with that color are intended for tooth whitening. In that regard, the oral care implement 2110 in the first package 2100 may have spiral bristles, which, as discussed herein above, is beneficial for tooth whitening. Furthermore, the mouthwash solution contained within the second package 2200 may be a mouthwash solution that has specific tooth whitening benefits. Finally, the dentifrice (or other oral care agent, such as a specific tooth whitening agent) within the third package 2300 may have specific chemistry that enhances tooth whitening. Thus, using the toothbrush 2100 in combination with the mouthwash solution and the dentifrice 2310 will enhance the tooth whitening of those products and achieve the best possible results.

Thus, using the color coded system described herein, various products can be grouped together based on the oral care benefit achieved with those products. Products that achieve tooth whitening can be grouped together based on each of the products that achieve tooth whitening being placed within a package that has the same color. Products that are used for tooth sensitivity can be grouped together based on each of the products that combat sensitivity in the teeth being placed within packages that have the same color. Any of various oral care benefits that are collectively addressed with a series of products will be placed in different packages, each of which has the same color on the visible designated area. This will provide a visual indication to a consumer that these various products should be used together to combat the particular problem that the consumer is attempting to address or to achieve a particular oral care benefit in the most advantageous manner.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A color coded oral care implement packaging system comprising:

a first packaged oral care product comprising:

a first package comprising a first product retaining cavity;

a first oral care implement positioned within the first product retaining cavity, the first oral care implement comprising a first tooth cleaning element field having a first characteristic configured to achieve one of a plurality of different oral care benefits; and a first designated area located on a visible surface of the first package, the first designated area being color coded with a first color selected to represent the first characteristic;

a second packaged oral care product comprising:

a second package comprising a second product retaining cavity;

a second oral care product positioned within the second product retaining cavity, the second oral care product having a second characteristic configured to achieve one of a plurality of different oral care benefits, the second packaged oral care product being different than the first packaged oral care product, the first characteristic being the same as the second characteristic; and a second designated area located on a visible surface of the second package, the second designated area being color coded with a second color selected to represent the second characteristic, wherein the first color is the same as the second color; and a color code key on each of the first and second packages, the color code key having a plurality of colors, the color code key comprising a first graphical portion linking the first color of the plurality of colors to the first characteristic and a third graphical portion linking a third color of the plurality of colors to a third characteristic, the third characteristic being different from the first characteristic.

2. The color coded oral care implement packaging system according to claim 1 wherein the first characteristic is selected from a group consisting of tooth whitening, interdental cleaning, and odor adsorption; and wherein the third characteristic is selected from a group consisting of tooth whitening, interdental cleaning, and odor adsorption.

3. The color coded oral care implement packaging system according to claim 1 wherein the first oral care implement is positioned within the first product retaining cavity so that the first tooth cleaning element field overlies a portion of the first designated area.

4. The color coded oral care implement packaging system according to claim 1 wherein the first oral care implement comprises a first handle and a first head, the first tooth cleaning element field extending from the first head.

5. The color coded oral care implement packaging system according to claim 1 wherein the first package comprises a first transparent panel and a first backer panel, the first product retaining cavity formed between the first transparent panel and the first backer panel, the first backer panel having an upper surface comprising the first designated area.

6. The color coded oral care implement packaging system according to claim 5, wherein the first transparent panel comprises a first three-dimensional contour that corresponds in shape to the first oral care implement.

7. The color coded oral care implement packaging system according to claim 1 further comprising:

a third packaged oral care implement comprising:

a third package comprising a third product retaining cavity;

a third oral care product positioned within the third product retaining cavity, the third oral care product being different than the first and second oral care products; and a third designated area located on a visible surface of the third package, the third designated area being color coded with the first color to represent the first characteristic.

8. A color coded oral care product packaging system comprising:

a plurality of packages, each of which contains at least one of a plurality of oral care products, each of the plurality of oral care products having one of a plurality of different oral care benefits, wherein the plurality of packages comprises a first package containing an oral care implement or toothbrush, a second package containing a mouthwash solution, and a third package comprising a toothpaste or dentifrice or a tube containing toothpaste or dentifrice; and a color coding system comprising a plurality of colors, each of the plurality of colors selected to be indicative of a specific one of the plurality of different oral care benefits;

wherein each of the plurality of packages comprising, on a visible area, a designated area having a color of the plurality of colors that is indicative of the oral care benefit which the oral care product in that package is configured to achieve, wherein the first, second and third packages are color coded with the same color, to indicate that the at least one of the plurality of oral care products contained within each of the first, second and third packages are intended to be used together to optimize the benefit of each of the first, second and third packages.

9. The color coded oral care product packaging system according to claim 8 wherein the oral care benefit is selected from a group consisting of tooth whitening, interdental cleaning, and odor adsorption.

10. The color coded oral care product packaging system according to claim 8, wherein the oral care implement or toothbrush is positioned in the first package so that a portion of the oral care implement or toothbrush that is configured to achieve the plurality of different oral care benefits overlies the designated area.

11. The color coded oral care product packaging system according to claim 8, wherein the first package comprises a transparent panel and a backer panel, a product retaining cavity formed between the transparent panel and the backer panel, the backer panel having an upper surface comprising the designated area.

* * * * *